US011744308B2

(12) United States Patent
Hathcock et al.

(10) Patent No.: US 11,744,308 B2
(45) Date of Patent: Sep. 5, 2023

(54) VISOR WITH INTEGRATED DRINKING VESSEL

(71) Applicants: Alan Joseph Hathcock, Fort Collins, CO (US); James Allen Trumbly, Austin, TX (US); Benjamin Ryan Phelps, Washington, DC (US)

(72) Inventors: Alan Joseph Hathcock, Fort Collins, CO (US); James Allen Trumbly, Austin, TX (US); Benjamin Ryan Phelps, Washington, DC (US)

( * ) Notice: Subject to any disclaimer, the term of this patent is extended or adjusted under 35 U.S.C. 154(b) by 0 days.

(21) Appl. No.: 17/738,309

(22) Filed: May 6, 2022

(65) Prior Publication Data

US 2022/0256960 A1 Aug. 18, 2022

Related U.S. Application Data

(63) Continuation of application No. 16/442,236, filed on Jun. 14, 2019, now Pat. No. 11,350,686.

(60) Provisional application No. 62/685,778, filed on Jun. 15, 2018.

(51) Int. Cl.

| | |
|---|---|
| ***A42B 1/241*** | (2021.01) |
| ***A42B 1/006*** | (2021.01) |
| ***A42B 7/00*** | (2006.01) |
| ***A42B 1/04*** | (2021.01) |
| ***A45F 3/16*** | (2006.01) |

(52) U.S. Cl.

CPC ..... *A42B 1/241* (2013.01); *A42B 1/006* (2013.01); *A42B 1/04* (2013.01); *A42B 7/00* (2013.01); *A45F 3/16* (2013.01)

(58) Field of Classification Search

CPC ..... A42B 1/241; A42B 1/006; A42B 1/04; A42B 1/00; A42B 1/24; A42B 7/00; A45F 3/20; A45F 2003/205; A45F 3/16; A45F 2200/0583; A45F 2003/166; A45F 3/18; A45F 2003/003; A45F 2005/002; B65D 81/361; B65D 81/363; A45C 2200/20; A41D 2400/46

USPC ..... 2/209.13, 209.12, 195.1, 195.6; 220/737, 220/739; 224/148.1, 148.2, 148.7, 181, 224/184.4–184.6

See application file for complete search history.

(56) References Cited

U.S. PATENT DOCUMENTS 3,068,865 A * 12/1962 Laszlo ..... A42B 3/288 2/5
4,586,280 A * 5/1986 Dane ..... A42B 1/004 40/406

(Continued)

*Primary Examiner* — F Griffin Hall

(57) ABSTRACT

It is common for the organizers of endurance sports to provide aid stations along the route where participants may receive water to prevent dehydration. To reduce waste at these events, organizers encourage 'cupless' races that requiring participants to carry their own vessels. The present invention comprises a hat with a visor, such as a baseball style cap, with a collapsible drinking vessel integrated into the visor. During the course of the race, a runner may encounter a water stop and require a vessel to contain the liquid for immediate consumption. At such time the runner can simply remove their hat and configure the vessel to the open position to receive the liquid. Post-consumption the vessel is configured back to the closed position and becomes seamlessly integrated into the visor with no negative effects upon the runner.

4 Claims, 7 Drawing Sheets

(56) References Cited

U.S. PATENT DOCUMENTS

| | | | | | |
|---|---|---|---|---|---|
| 4,681,244 | A * | 7/1987 | Geddie | B67D 1/08 | D2/866 |
| 4,739,905 | A * | 4/1988 | Nelson | A42B 1/24 | D2/866 |
| 5,340,006 | A * | 8/1994 | Li | A45F 5/00 | 224/181 |
| 5,622,261 | A * | 4/1997 | Mobley | G09F 23/00 | 206/522 |
| 5,966,743 | A * | 10/1999 | Flann | B65D 11/06 | 2/209.13 |
| 5,970,523 | A * | 10/1999 | Atkins | A42B 1/24 | 2/209.13 |
| 6,050,099 | A * | 4/2000 | Lopa | A61F 7/10 | 62/304 |
| 6,105,827 | A * | 8/2000 | Rowan | A42B 3/048 | 224/148.1 |
| 6,283,344 | B1 * | 9/2001 | Bradley | A42B 3/048 | 224/148.2 |
| 6,938,831 | B1 * | 9/2005 | Brown | A42B 3/285 | 239/311 |
| 7,681,253 | B2 * | 3/2010 | Kobayashi | A61F 9/045 | 2/209.13 |
| 8,277,069 | B2 * | 10/2012 | Zuloff | A42B 1/24 | 2/209.13 |
| 9,179,724 | B1 * | 11/2015 | Schultz | A42B 3/048 | |
| 10,342,278 | B1 * | 7/2019 | Blau | A42B 3/048 | |
| 10,624,438 | B2 * | 4/2020 | Hoskins | A45F 3/20 | |
| 11,350,686 | B2 * | 6/2022 | Hathcock | A42B 1/04 | |
| 2007/0028359 | A1 * | 2/2007 | Robinson | A42B 3/048 | 2/171 |
| 2019/0090572 | A1 * | 3/2019 | Atkins | A42B 3/048 | |

* cited by examiner

VISOR WITH INTEGRATED DRINKING VESSEL

CROSS-REFERENCE TO RELATED APPLICATION

The present application claims priority to U.S. patent application Ser. No. 16/442,236, filed Jun. 14, 2019 and entitled "Visor With Integrated Drinking Vessel", which claims priority to U.S. Provisional Application No. 62/685,778, filed Jun. 15, 2018.

BACKGROUND

Over the past several years there has been a trend to minimize waste in endurance sports, such as marathon racing, in hopes of making the competitions more eco-friendly. It is common practice at these events to provide aid stations along the route where participants may receive water or sports drink to prevent dehydration. Prior to the eco-friendly movement, event organizers would provide disposable cups filled with a beverage to the participants, which would in-turn be discarded along the course post-consumption. To reduce litter caused by the disposable cups, race organizers have addressed this issue by encouraging "cupless" races, requiring participants to bring their own device such as a cup or bottle that the participant must carry and use during the race. Several such devices are currently on the market, but they have the drawback of requiring the participant to either carry the device in hand, in a backpack, or folded up in a pocket.

The present invention entails a cup integrated into the visor of a hat so that the participant can simply wear the cup seamlessly as part of her race day attire, avoiding any extra gear.

SUMMARY OF THE INVENTION

Hats are critical pieces of race gear to participants of endurance sports, such as long-distance running, by providing multiple benefits including protection from the elements and aiding in temperature regulation. Hydration during these sports is also essential. The embodiment of the present invention comprises a hat with a visor, such as a baseball style cap or sports visor, with a collapsible drinking vessel discretely located under and incorporated into the visor, thus increasing the utility and value to the runner. The vessel operates between an open and closed position.

During the course of the race, the runner may encounter a source of hydration, such as a water station, and require a vessel to contain the liquid for consumption. At such time the participant can remove their hat and configure the vessel to the open position so that the vessel is able to receive the liquid. After consumption, the vessel is configured back to the closed position and becomes seamlessly integrated into the visor so that it has no negative effects upon the runner.

The vessel is an open container intended for the immediate consumption of the beverage rather than long-term storage of a liquid. The primary factors taken into consideration in the preferred embodiment of the invention include: minimizing weight, simplicity to transform from an open to a closed position, material choices to maintain a healthy and sanitary drinking environment, and maintaining a seamless profile to the bill when not in use.

Variations and modifications can be made to the embodiments of the present disclosure. Other embodiments and aspects of the invention are described in detail herein and are considered a part of the claimed invention. Such other embodiments and aspects can be understood with reference to the following detailed description, accompanying drawings, and claims.

DETAILED DESCRIPTION OF THE INVENTION

The primary scope of the invention is an improvement upon the visor of a baseball style hat to add the utility of an integrated drinking vessel. The vessel is thin-walled and operates between an open and closed position. When the vessel is in the open position a cavity is created forming an open-ended cup that can hold liquids for immediate consumption. In the open position, the vessel cavity has a basin configured to contain liquid. In the preferred embodiment, the cup has no lid or sealing mechanism and thus, it is not intended for long-term storage or extensive transport of the liquid. When the vessel is essentially void of liquid, it can be transformed into the collapsed or closed position. In the closed position, the body of the vessel conforms to the bill of the visor and is essentially out of the way of the user. In the closed position, the volume within the cavity is minimized and essentially zero.

It is envisioned by the inventor that the preferred embodiment described herein would integrate into a hat used by participants engaging in endurance sports such as marathons and distance running where aid stations may provide water to prevent, dehydration, but may not provide a vessel to enable consumption.

Figure 1:
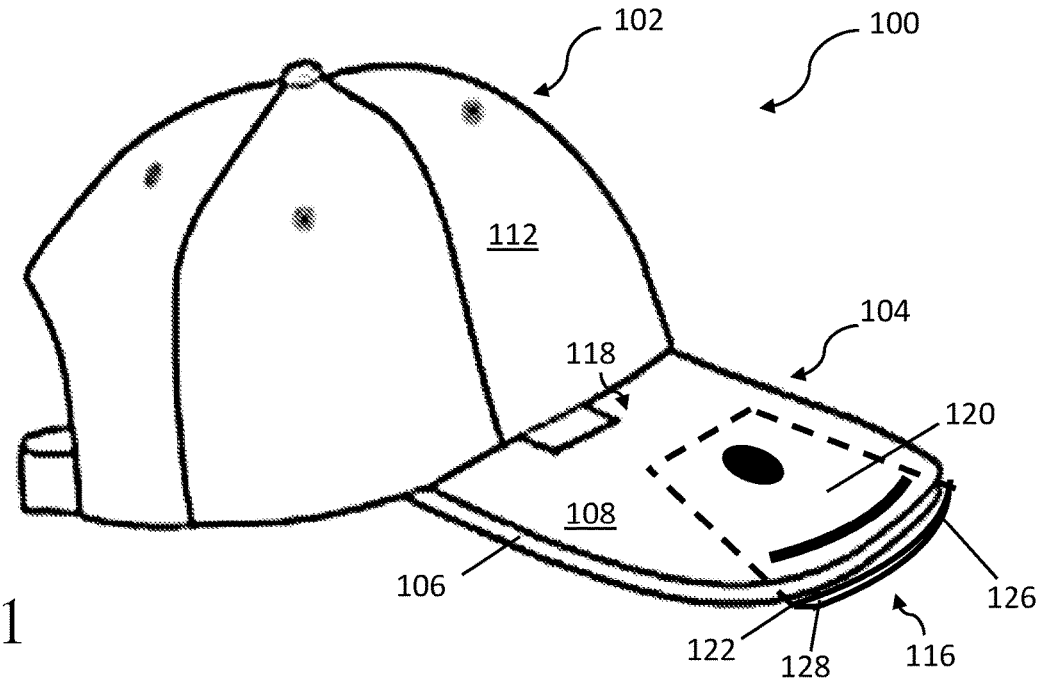
FIG. 1 is an isometric view of the baseball style hat with the cup in the closed position.
Figure 2:
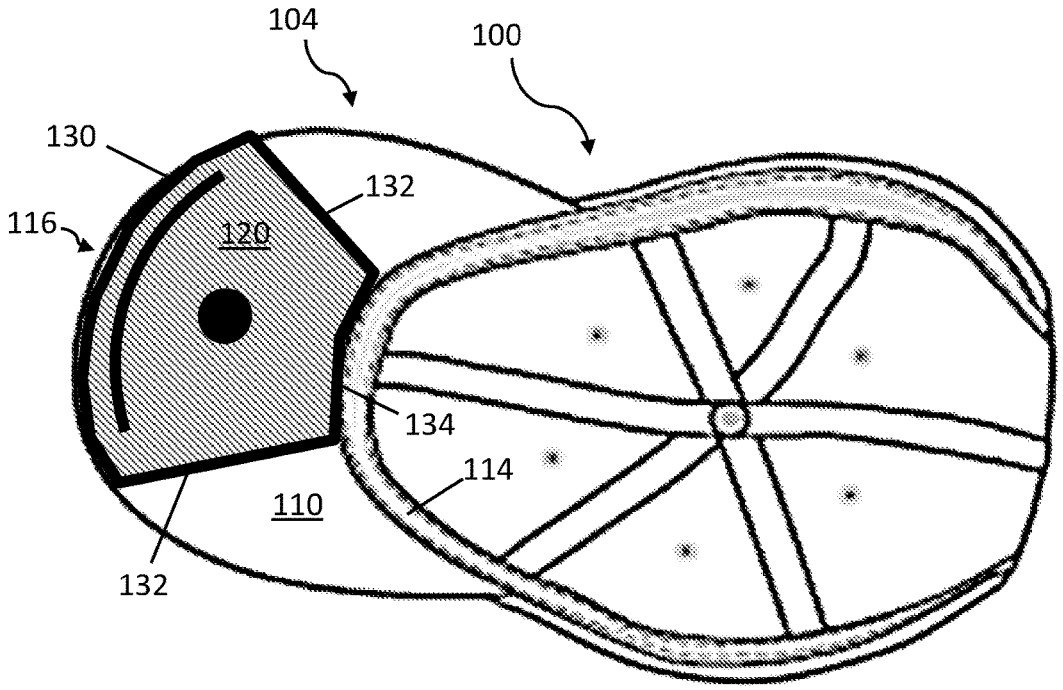
FIG. 2 is a bottom view of the hat with the cup in the closed position.

With reference to the figures, FIG. 1. shows a baseball style hat (100) generally comprising a crown (102) and visor (104). The visor (104) may also be called a brim, peak, or bill. The visor (104) is further comprised of plurality of horizontal surfaces commonly identified as an upper peak (108), sandwich (106), and a lower peak (110). The body of the crown (102) may be comprised of a number of panels (112) bound together to create a dome. Also shown in FIG.

1 is the outline of the vessel (120) in the closed position which is positioned under the visor (104) and wherein the vessel rim (130) is generally coincident with the visor anterior edge (116).

The vessel (120) is constructed of an upper vessel wall (122) and lower vessel wall (124) which are essentially mirrored images of the other. The walls have a perimeter that are joined along the vessel posterior edge (134) and on both edges along the vessel side edges (132) and are collectively referred to as the seam or sealed edges. As an alternative, the posterior edge (134) and the vessel side edges (132) may be a continuous edge, such as a continuous arc, rather than discrete elements. The process to join the wall along the aforementioned edges may include mechanical means, such as heat seal, adhesives, stitching, or they may be created by a fold in a common base material. The perimeter which is sealed forms a cavity between the upper and lower vessel walls and becomes the basin of the vessel.

Figure 8:
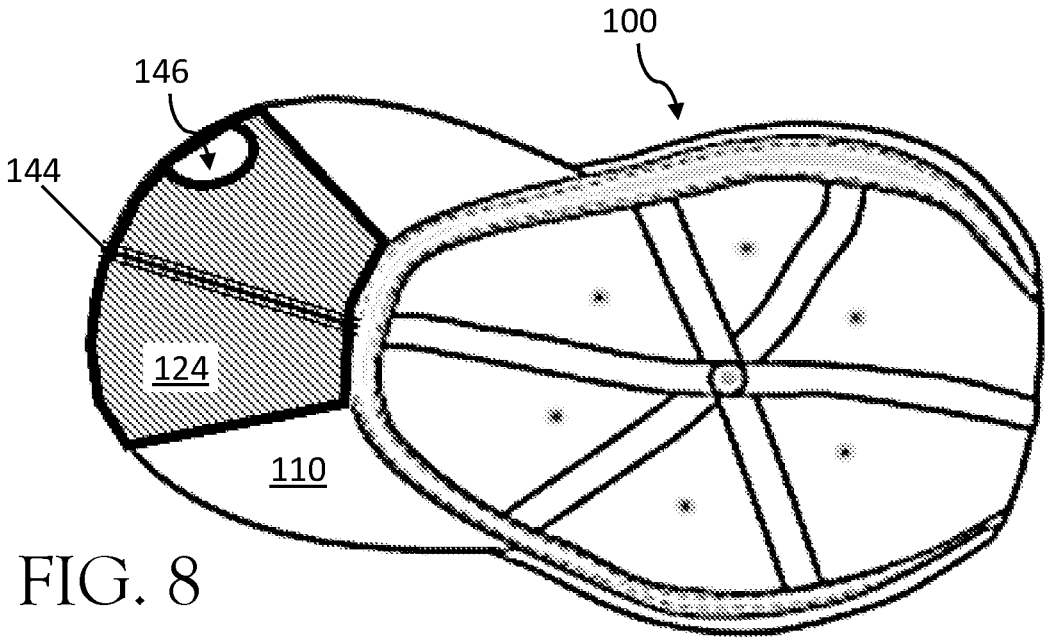
FIG. 8 is a bottom view of the hat with the elastic closure device.
Figure 9:
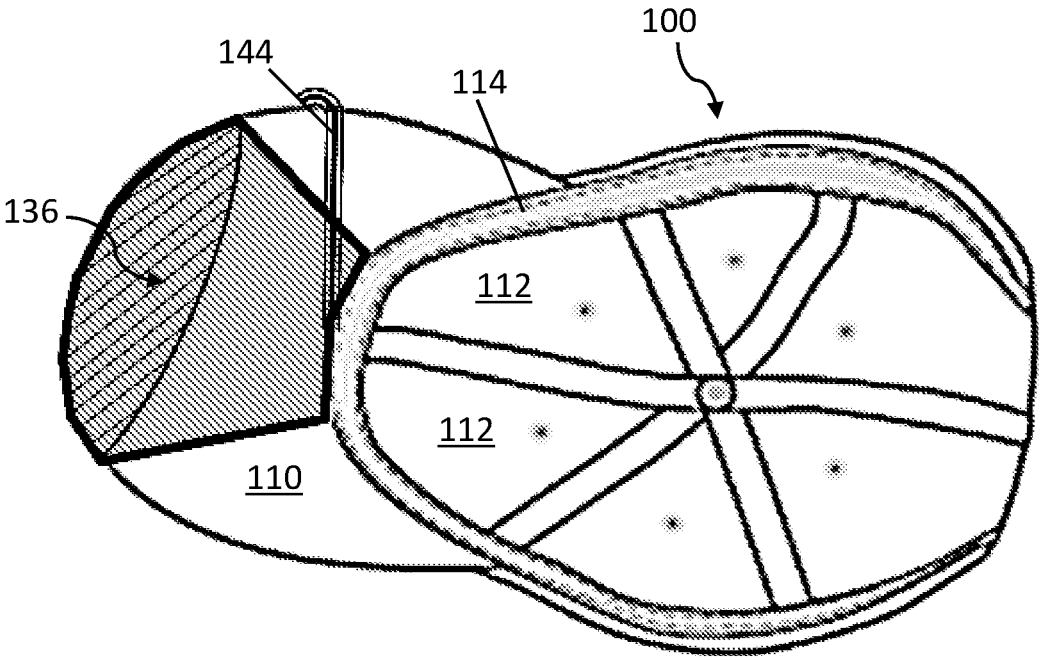
FIG. 9 is a bottom view of the hat with the cup in an open position.

The vessel (120) has some portion along the perimeter of the upper wall (122) and lower wall (124) which is not sealed and creates an opening into the basin or the mouth of the vessel (120) from wherein the user can fill or drink liquid. The mouth of the vessel (120) is open-ended along the vessel rim (130) thus creating an upper vessel rim (126) and a lower vessel rim (128) along the upper vessel wall (122) and lower vessel wall (124). While the figures show the cup to have a generally trapezoidal shape comprising two legs, a concave shorter base adjacent to the crown, and a larger, convex base adjacent to the rim, it should be understood that the vessel (120) may take on any shape to form a cup. A notch or tab (146) may be placed along the lower vessel rim (128) to aid in the separation of the upper and lower vessel walls (122 and 124) as shown in FIG. 8.

The upper vessel wall (122) and lower vessel wall (124) may be constructed from a common base material or from different materials. As an alternative, the vessel may be molded as a single unit. In the preferred embodiment, the vessel walls would be constructed of a BPA-free plastic sheeting, but alternatives may include other thin-film or sheet plastics, such as polypropylene, silicone, vinyl, or PVC, that are impermeable to water. Additionally, a film may be laminated onto a textile to create a water-resistant barrier and in such case, the upper vessel wall (122) may be characterized simply by a laminated layer on the lower peak (110). As the vessel (120) may be intended for only very short-term containment of liquids, the materials for the upper vessel wall (122) and lower vessel wall (124), as well as the process for joining these walls, may only need to be marginally waterproof—thus even a non-laminated, porous, tight-knit textile may provide an adequate material for construction.

The upper vessel wall (122) is secured to the lower peak (110) by mechanical means, which may include stitching or adhesives, such that the upper vessel wall is form fitted with the upper peak (108). The entire top side of the upper vessel wall (122) may be secured to the lower peak (110) or it may be partially secured. To not interfere with the user's line-of-sight when the vessel (120) is in the closed position, it is ideal for the lower vessel wall (124) to coincide with the upper vessel wall (122). There are various methods which may be employed individually or in combination to accomplish this task.

Figure 3:
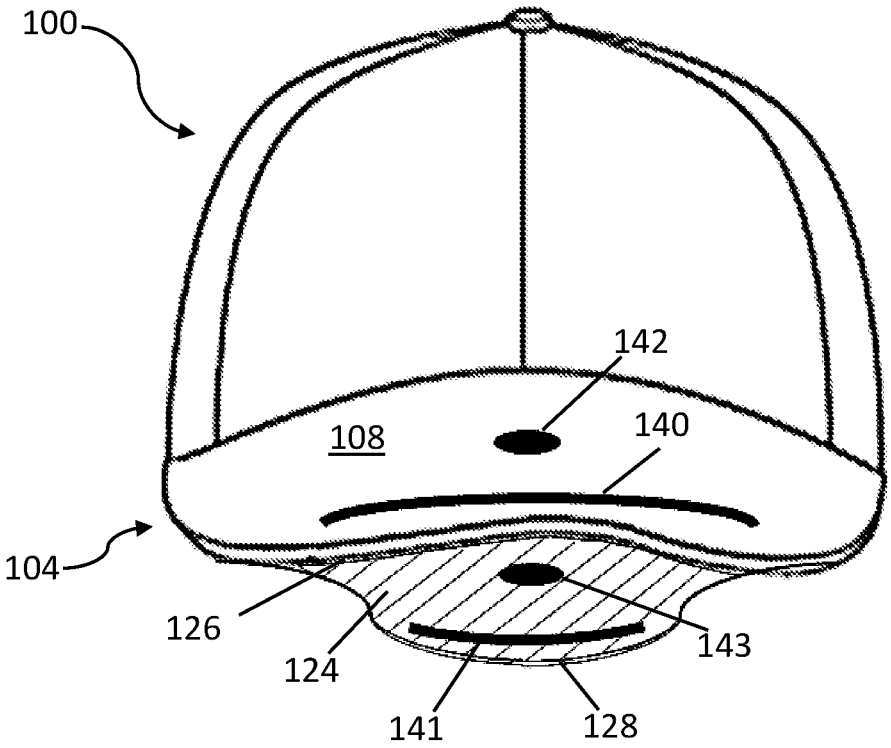
FIG. 3 shows the front view of the hat with the cup in the open position.
Figure 4:
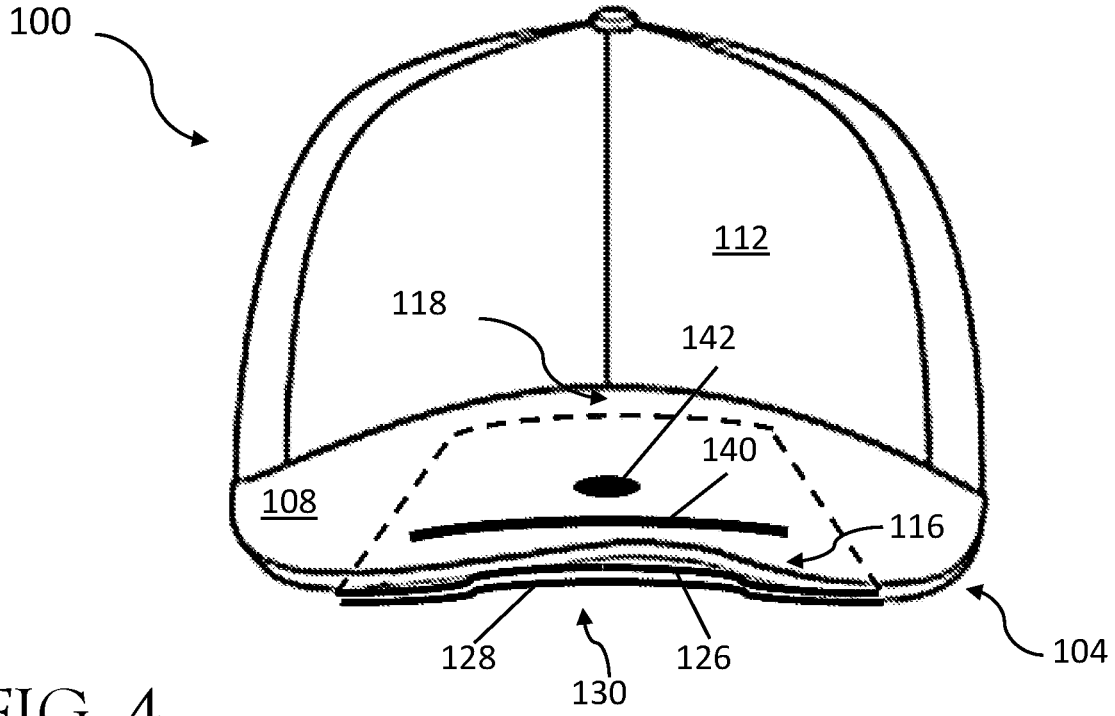
FIG. 4 is a front view of the hat with the cup in the closed position.

As shown in FIG. 3, there are an upper and lower point closure device (142 and 143) and an upper and lower strip closure devices (140 and 141). In one embodiment of the invention, the upper and lower point closure devices (142 and 143) may comprise mating mechanical fastening devices, such as snaps or buttons positioned within the vessel cavity (136) on the upper and lower vessel walls (122 and 124). In a similar fashion, a mechanical solution for an upper and lower strip closure device (140 and 141) may comprise mating press-fit plastic seals, or plastic zippers, such as those found on Ziploc® type bags, positioned within the vessel cavity (136) on the upper and lower vessel walls (122 and 124).

Alternatively, the point or strip closure devices may comprise a magnetic fastener arrangement, such as a magnet-to-magnet or magnet-to-metal arrangement, for securing the upper and lower vessel walls (122 and 124). The upper and lower point closure device (142 and 143) may consist of a simple magnetic button arrangement while the upper and lower strip closure device (140 and 141) may consist of a sheet type magnet arrangement. Unlike the button and snap mechanical fasteners described above, the magnet solutions allows for a wider variety of placement options as the upper magnetic fastener could be secured above the upper peak (108), within the sandwich (106), or on either side of the upper vessel wall (122) and the lower magnetic fastener could be secured on either side of the lower vessel wall (124). Magnetic fastener solutions may also benefit from speed in alignment and durability.

Figure 5:
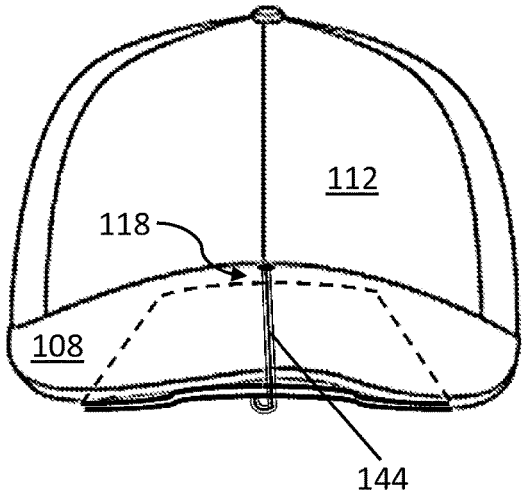
FIG. 5 is a front view of the hat with an elastic closure device.
Figure 6:
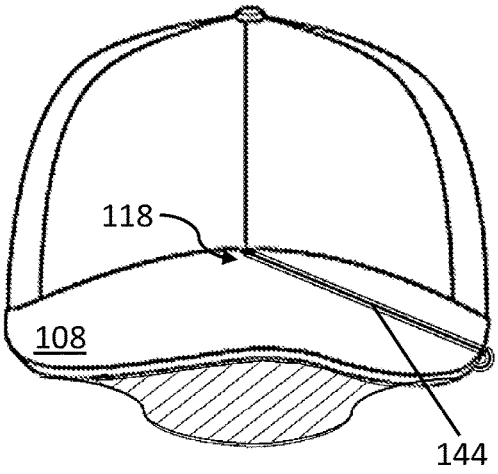
FIG. 6 is a front view of the hat with the cup in an open position.
Figure 7:
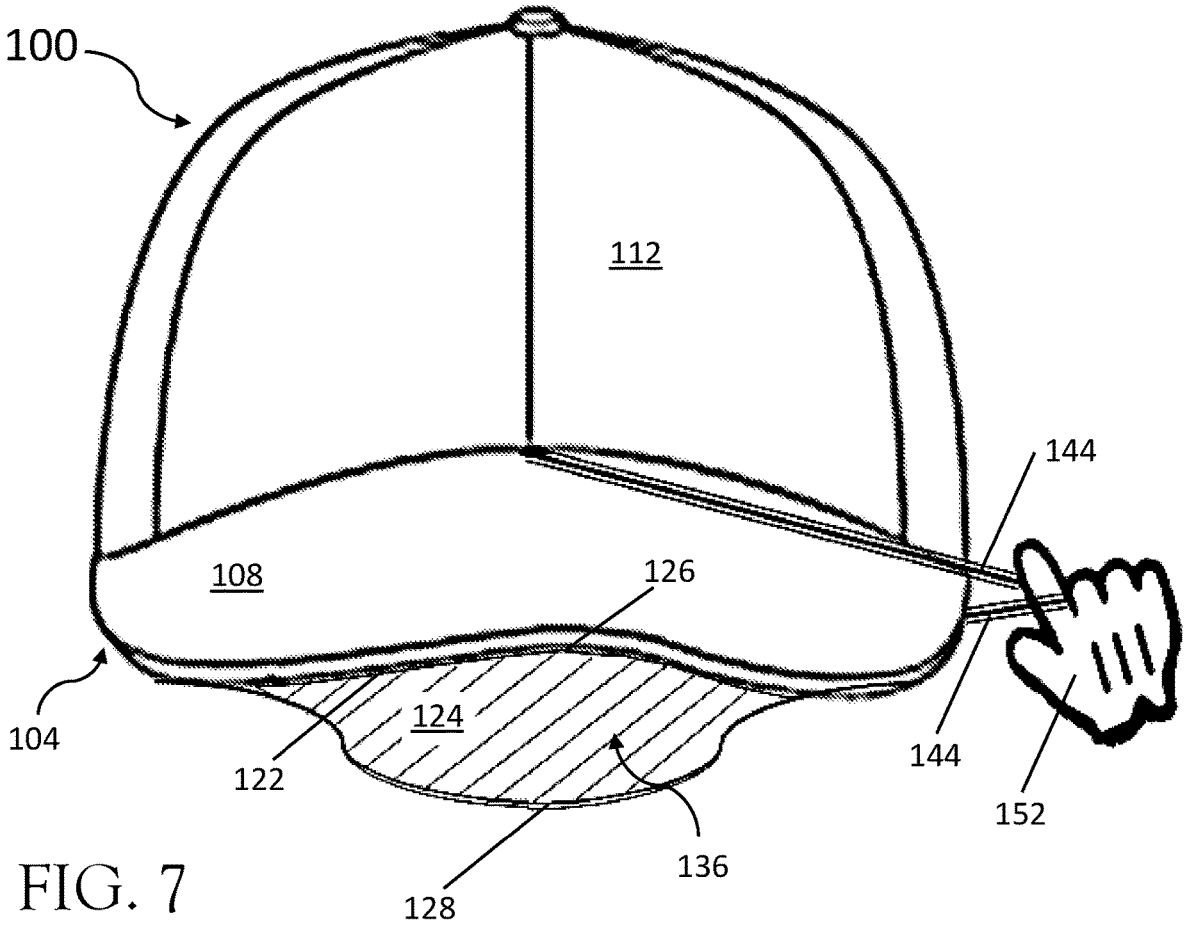
FIG. 7 illustrates user interaction to secure the closure device.

FIGS. 5, 6, and 7 illustrate another method for securing the lower vessel wall (124) to the upper vessel wall (122) by means of an elastic cord (144). As shown in FIG. 5, the elastic cord (144) passes across the lower vessel wall (124) to secure it to the upper vessel wall (122) when the vessel (120) is in the closed position. As shown in FIG. 7, the user (152) may release the lower vessel wall (124) simply by moving the elastic cord (144) to the side of the visor (104). Both ends of the elastic cord (144) are secured near the visor posterior edge (118). In some embodiments, the elastic cord (144) may pass through either the front panel (112) or the visor posterior edge (118). In some embodiments, the elastic cord (144) may pass through the sweatband (114). In some embodiments, the elastic cord (144) may be a continuous loop passing through a hole near the visor posterior edge (118). The elastic cord (144) may be made from any number of elastic materials including rubber, braided bungee cord, or various textiles with elastic properties, such as spandex, lycra, or elastane, and may also take a variety of shapes such as tubular, or flat bands.

Figure 10:
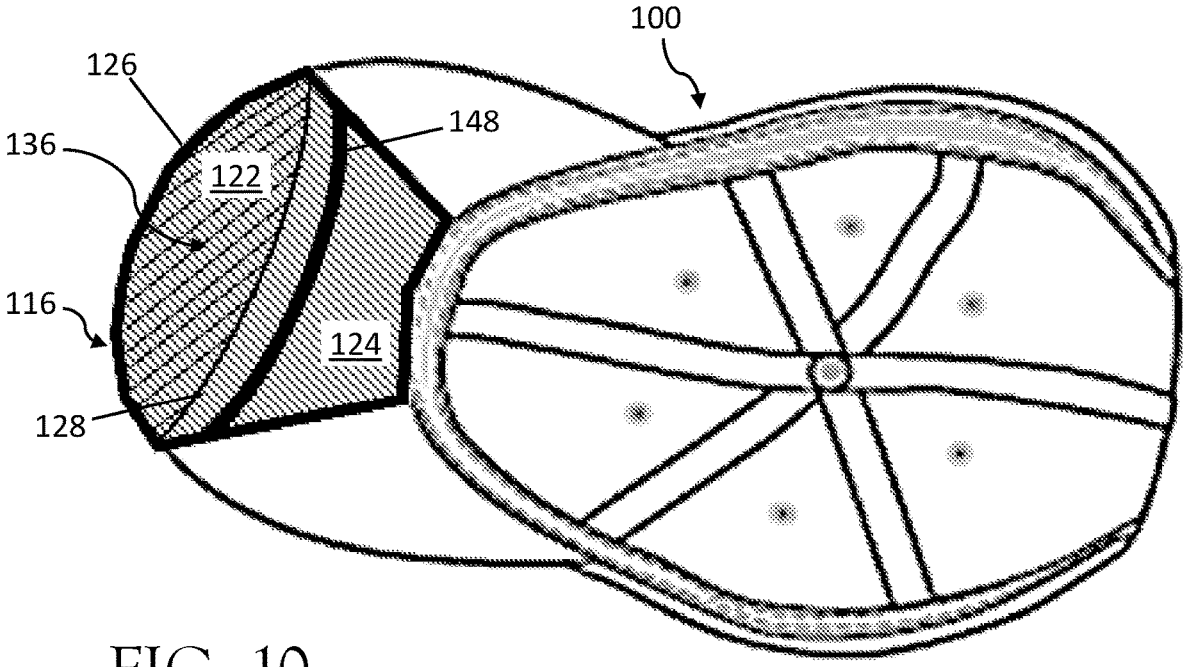
FIG. 10 is a bottom view of the hat with a spring like mechanism.

FIG. 10 illustrates a vessel (120) wherein a spring-like member (148) is integrated into the lower vessel wall (124). The spring-like member (148) may be positioned coincident or nearby the lower vessel rim (128). In this embodiment, the spring-like member (148) may be made of spring steel or a semi-rigid polymer, including but not limited to: low-density polyethylene (LDPE), high-density polyethylene (HDPE), polypropylene (PP), polyvinyl chloride (pvc), polystyrene (PS), nylon, teflon, ABS, etc. The spring-like member (148) may also be produced from heavy card stock, cardboard, rubber, and the like.

Figure 12:
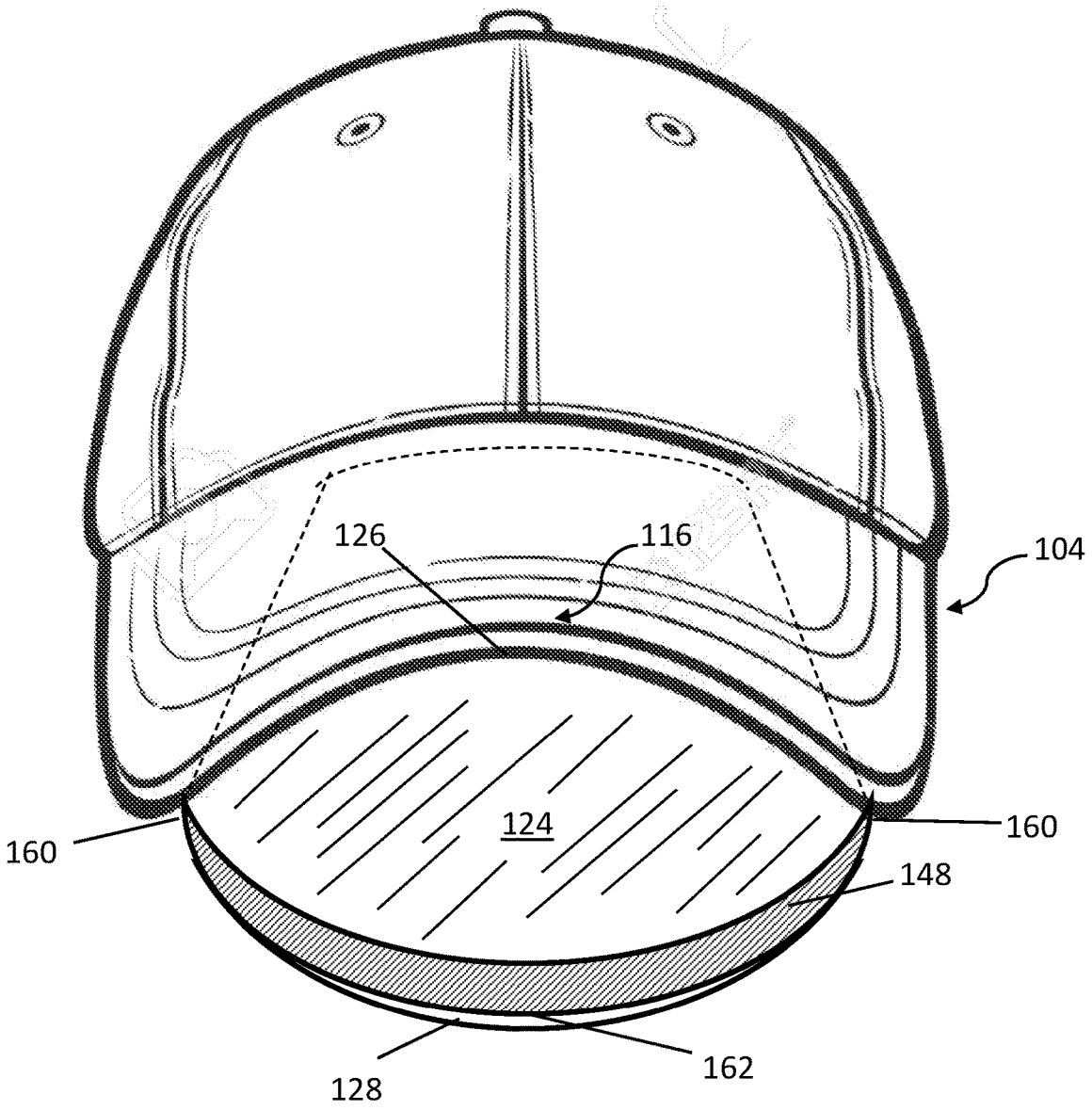
FIG. 12 is a front view of the hat with vessel in the open position and a spring-like mechanism.
Figure 13:
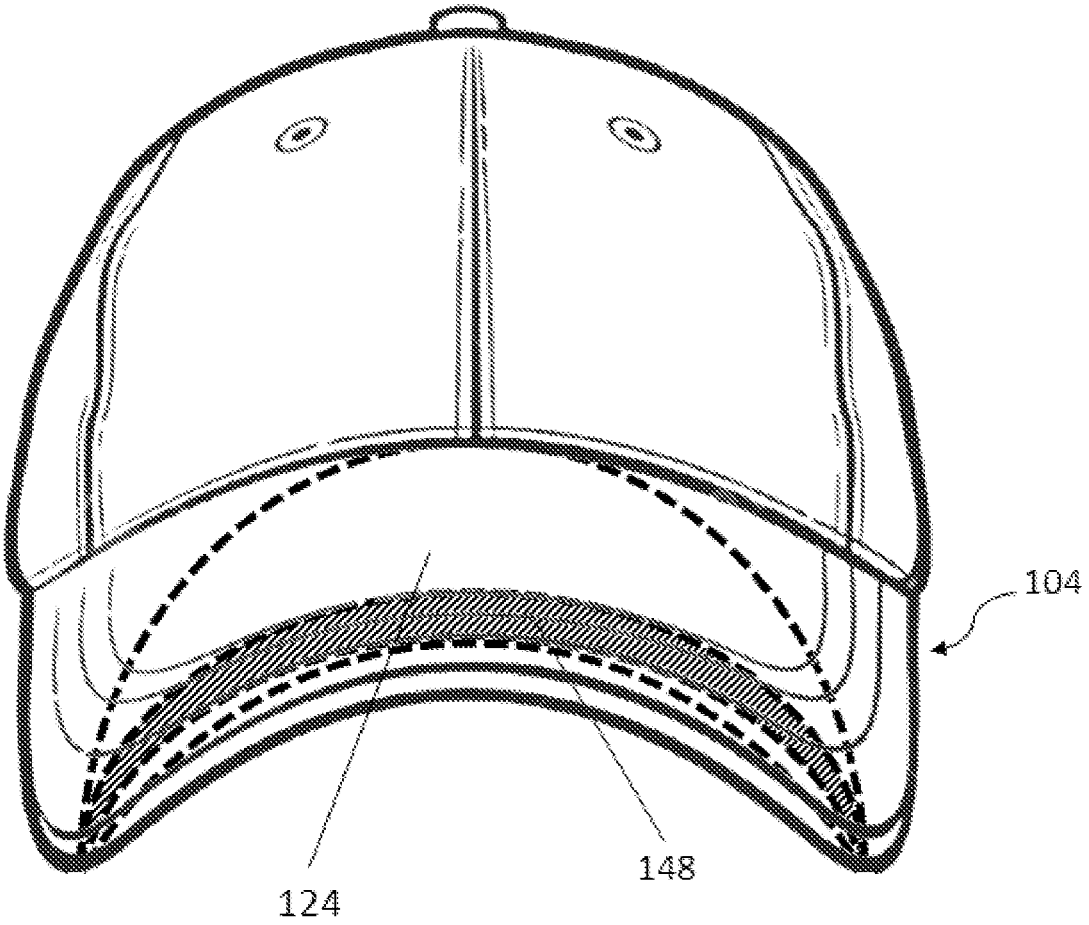
FIG. 13 is a front view of the hat with vessel in the closed position and a spring-like mechanism.

The spring-like member is further disclosed in FIG. 12 and FIG. 13. In FIG. 12 the vessel is shown in the open position with the spring-like member (148) positioned at the forward end of the lower wall (124). As shown in FIG. 12, the spring-like member (148) may be crescent shape. In the preferred embodiment, the leading edge of spring-like member (162) generally conforms with the visor anterior edge (116).

The important characteristic of the spring-like member is the ability to transition from an upward concave state, as shown in FIG. 12, to a downward concave state, as shown in FIG. 13. This design is best applied to a visor (104) with a predominantly downward concave shape but can also be applied to a flat visor (104). The spring like member may travel in a sleeve on the lower wall (124) or may be fixed to the lower wall (124). The transition from closed to open is achieved by applying pressure on the lateral edges of the visor to further enforce the downward concave visor (104) and upper wall, (126) while aiding the lower vessel rim (128) to pop out into a concave upward position, by way of encouraging the spring-like member into a position opposing the natural concave downward shape of the upper vessel rim (126). The transition to the closed position is achieved by adding pressure to the spring-like member and causing it to bow back into the concave downward shape corresponding to the lower peak.

In an alternative embodiment, a flap or pocket may be used to secure the lower vessel rim (128) in the closed position. The flap may comprise a material extending from a point near the upper vessel rim, upper peak, or lower peak which secures to the exterior surface of the lower vessel wall (124) Alternatively, the flap may comprise a material extending from the lower vessel wall (124) which may traverses around the visor anterior edge (116) to connected to the upper peak (108). Alternatively, the flap extending from the lower vessel wall (124) may secure to the upper vessel rim (126) or lower peak (110). As an alternative, a pocket may be formed by joining material around the perimeter of the visor anterior edge (116) such that the pocket opens towards the visor posterior edge (118), and the pocket is configured to receive the lower vessel rim (128).

Figure 11:
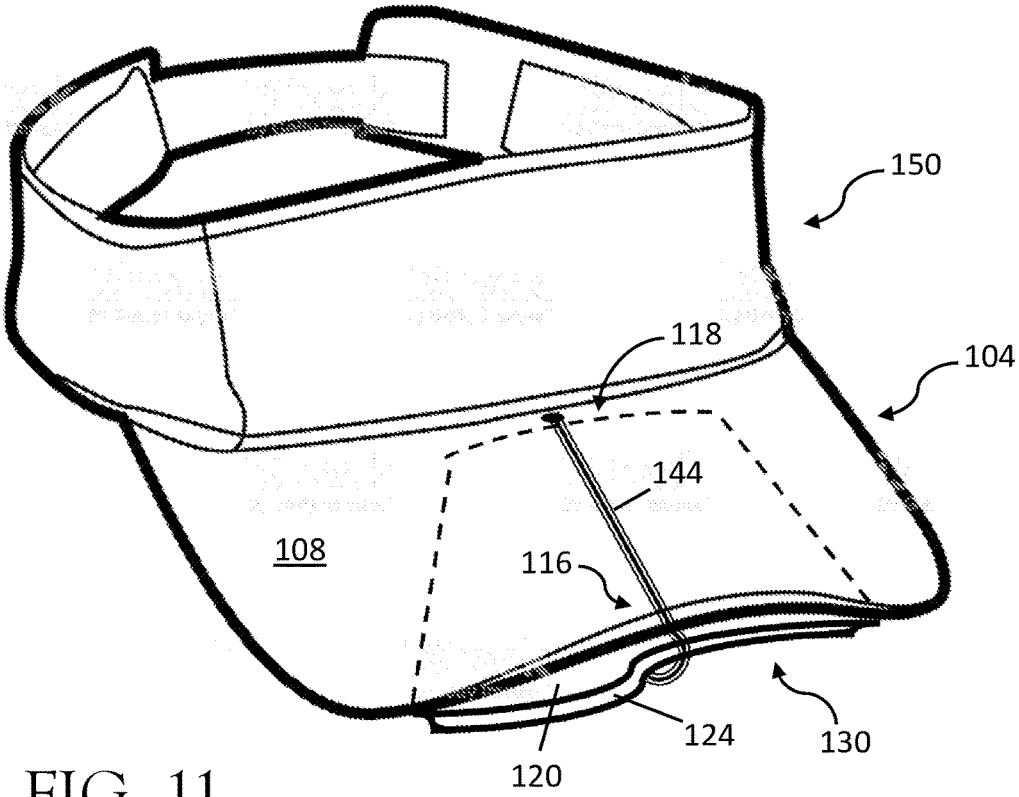
FIG. 11 is an isometric view of a cup in the closed position implemented on a sun visor style hat.

FIG. 11 illustrates a similar invention embodied into a sun visor (150).

In yet another embodiment, it has been conceived that the upper and lower vessel walls (122 and 124) may be placed within the sandwich (106) such that the vessel cavity (136) is created within the upper and lower peak (108 and 110).

An alternative embodiment may include a lid or sealing mechanism such that the vessel (120) may hold water regardless of orientation. This lid may be integral to the vessel (120) or removable. One non-limiting example of an integrated lid type mechanism may include an expandable lower vessel wall (124) or a lower vessel wall (124) with a belly, such that liquids can be maintained in the vessel cavity (136) while still allowing the upper and lower strip closure device (140 and 141) to seal.

An alternative method to hold the vessel (120) in the closed position may include a lower vessel wall (124) which extends beyond the visor anterior edge (116) and is configured to partially fold over the upper peak. In such a design, the closure devices when mated join the surface of the upper peak (108) and the lower vessel wall.

An alternative embodiment may include a novelty type vessel (120) with an extended visor (104) such that the vessel (120) is capable of holding volumes in the range of 8 to 20 oz. While it is common for the length of a visor to extend four to six inches from the visor posterior edge (118) to the visor anterior edge (116), the novelty visor could have a length ranging from 8 to 16 inches or greater.

What is claimed is:

1. A collapsible drinking vessel attached to a visor of a hat comprising:

an upper wall positioned below and attached to the visor of the hat, and a lower wall positioned below the upper wall and having a perimeter, with the upper wall and lower wall being constructed from a water impermeable, sheetlike material;

wherein the upper wall and the lower wall are joined to form a cavity of the drinking vessel, and wherein a mouth of the drinking vessel is formed by an opening between the upper wall and lower wall, said mouth forming an upper rim and a lower rim which encircle the mouth of the drinking vessel; and wherein the lower wall includes a spring-like member which is integrated into the lower wall near the mouth of the drinking vessel, positioned at a forward end of the lower wall coincident to the lower rim, said spring-like member adapted to open and close the mouth of the drinking vessel.

2. The collapsible drinking vessel of claim 1, wherein the upper wall is universally attached to the visor.

3. The collapsible drinking vessel of claim 1, wherein the spring-like member comprises a semi-rigid polymer.

4. The collapsible drinking vessel of claim 1, wherein the visor has an anterior edge, and the spring-like member includes a leading-edge, generally conforming in shape to the anterior edge of the visor.

* * * * *